US007707665B1

(12) United States Patent
Hong

(10) Patent No.: US 7,707,665 B1
(45) Date of Patent: May 4, 2010

(54) SHOWER WATER CONSERVATION APPARATUS

(76) Inventor: Kwangill Hong, 13704 Osborne St., Arleta, CA (US) 91331

( * ) Notice: Subject to any disclaimer, the term of this patent is extended or adjusted under 35 U.S.C. 154(b) by 0 days.

(21) Appl. No.: 12/220,343

(22) Filed: Jul. 24, 2008

(51) Int. Cl.
*A47K 3/28* (2006.01)

(52) U.S. Cl. ..... 4/597; 4/605

(58) Field of Classification Search ..... 4/597, 4/605; 137/337
See application file for complete search history.

(56) References Cited

U.S. PATENT DOCUMENTS 2,829,669 A * 4/1958 Luzynski ..... 137/533.21
3,946,802 A * 3/1976 Christenson ..... 165/297
4,120,635 A * 10/1978 Langecker ..... 425/535
4,160,461 A * 7/1979 Vataru et al. ..... 137/337
4,224,700 A 9/1980 Bloys
4,554,688 A * 11/1985 Puccerella ..... 4/668
4,854,498 A 8/1989 Stayton
4,854,499 A * 8/1989 Neuman ..... 236/93 B
5,004,014 A * 4/1991 Bender ..... 137/624.12
5,277,218 A 1/1994 Sanchez
5,285,537 A * 2/1994 Hanks ..... 4/597
5,564,462 A * 10/1996 Storch ..... 137/337
5,678,258 A * 10/1997 Healy ..... 4/601
5,689,543 A 11/1997 Duke et al.
5,692,675 A 12/1997 Arlie
5,862,544 A 1/1999 Placencia
6,049,919 A * 4/2000 Roteman ..... 4/602
6,285,178 B1 * 9/2001 Ball et al. ..... 323/351
7,024,706 B2 4/2006 Hess

* cited by examiner

*Primary Examiner*—Gregory L Huson
*Assistant Examiner*—Karen Younkins
(74) *Attorney, Agent, or Firm*—Albert O. Cota

(57) ABSTRACT

A shower water conservation apparatus (10) that conserves the shower water by storing the initially cooled water that is produced by a hot water source (124). The initially cooled water is routed by a series of pipes and timed valves into a water reservoir assembly (19), such as a bellows (20), where the water is stored for later use. The cooled water from the bellows (20) is timely released and mixed with flow of cold water from a cold water source (126). The mixed cold water is further mixed with the now hot water from the hot water source (124) before the mixed hot and cold water is manually regulated and applied through a shower head (122).

1 Claim, 3 Drawing Sheets

SHOWER WATER CONSERVATION APPARATUS

TECHNICAL FIELD

The invention generally pertains to water conservation, and more specifically to a shower water conservation apparatus that stores an initially cooled water flow that is applied from a hot water heater prior to the water becoming hot. The stored cool water is then applied at a later time, into a regulated mixture of hot and cold water flow during shower usage, thereby preventing a needless waste of water.

BACKGROUND ART

Previously, many types of shower water conservation devices have been used to provide an effective means for saving water when showering. Typically, when a person is ready to shower, the hot water valve is turned on and the person waits until the shower water is hot. The person then adjusts the water mixture until the desired water temperature is achieved. The reason for the wait is that in many cases the water heater is located some distance from the shower and the water in the pipes leading to the shower has been standing, thus causing the water to cool down and to reach equilibrium with the prevailing ambient temperature. Obviously, the initial cooled water is wasted because it is drained into the sewer system.

A search of the prior art did not disclose any patents that possess the novelty of the instant invention, however the following U.S. patents are considered related:

| Patent Number | Inventor | Issue Date |
|---|---|---|
| U.S. Pat. No. 4,224,700 | Bloys | Sep. 30, 1980 |
| U.S. Pat. No. 4,854,498 | Stayton | Aug. 8, 1989 |
| U.S. Pat. No. 4,854,499 | Newman | Aug. 8, 1989 |
| U.S. Pat. No. 5,277,218 | Sanchez | Jan. 11, 1994 |
| U.S. Pat. No. 5,285,537 | Hanks | Feb. 15, 1994 |
| U.S. Pat. No. 5,689,543 | Duke et al. | Nov. 25, 1997 |

U.S. Pat. No. 4,224,700 discloses a water conservation shower device that incorporates a stopper for insertion into the shower drain which includes a water pump attached to a shower head. Water accumulated in the bottom of the shower is re-circulated and reapplied through the shower head.

U.S. Pat. No. 4,854,498 discloses a shower temperature control system that includes a mixing valve which is connected between the hot and cold sources of water and a shower head. A gear motor shaft is connected to the mixing valve and controls the blend using a temperature sensor positioned in the shower plumbing.

U.S. Pat. No. 4,854,499 discloses a temperature sensitive shower diverter valve for diverting shower water used between the water source and the shower head.

U.S. Pat. No. 5,277,218 discloses a water delivery conduit operative through a valve member which directs water from a shower conduit to a storage tank. The storage tank permits selective use of water from a primary conduit or from the delivery conduit for the utilization of water therefrom.

U.S. Pat. No. 5,285,537 discloses an apparatus that includes a pickup head mounted to a shower drain, which is operative through a storage tank for pressurized flow to an auxiliary shower head.

U.S. Pat. No. 5,689,543 discloses a water conservation system for a shower. The system utilizes a foot operated control valve piped to a T-spigot that is connected to the shower head, thereby reducing the water flow by usage only when required.

For background purposes and as indicative of the art to which the invention is related reference may be made to the remaining patents located in the search:

| Patent Number | Inventor | Issue Date |
|---|---|---|
| U.S. Pat. No. 4,554,688 | Puccerella | 26 Nov. 1985 |
| U.S. Pat. No. 5,692,675 | Arlie | 2 Dec. 1997 |
| U.S. Pat. No. 5,862,544 | Placencia | 26 Jan. 1999 |
| U.S. Pat. No. 7,024,706 | Hess | 11 Apr. 2006 |

DISCLOSURE OF THE INVENTION

The shower water conservation apparatus (SWCA) is designed to conserve shower water during the initial water-flow interval when the cooled shower water is being heated. In its basic design configuration the SWCA is comprised of a) a first means for allowing a water flow of initially cool water to flow from a hot water source into a water reservoir assembly, b) a second means for shutting off the water flow from the hot water source into the water reservoir assembly, and allowing the water flow to be applied through a shower head, c) a third means for simultaneously allowing the water flow from the water reservoir assembly and from a cold water source to mix and be applied through the shower head, and d) a fourth means for shutting off the water flow as specified in steps a), b) and c) and allowing the water flow from the hot water source to be applied through a manual hot water valve (V5) and through the shower head, and the water flow from the cold water source to be applied through a manual cold water valve (V6) and through the shower head. The two manual valves (V5,V6) are connected in series with their respective hot and cold water flow paths to allow a bather to regulate the water pressure and the temperature of the water that is applied through the shower head.

In the first means the water flow from the hot water source is applied through a solenoid valve (V1), a coiled pipe and into the water reservoir assembly.

In the second means the water flow from the hot water source into the water reservoir assembly is shut off by closing the solenoid valve (V1) and opening a valve (V2). This step allows the water from the hot water source to be applied directly through the shower head.

In the third means a third solenoid valve (V3) and a fourth solenoid valve (V4) are opened allowing the cooled water from the water reservoir assembly and the cold water from the cold water source to be mixed and applied through the shower head.

In the fourth means the solenoid valves (V2) and (V4) are closed allowing the manually controlled valves (V5 and V6) to adjust the pressure and the temperature of the water flowing from the shower head. The opening and closing of the solenoid valves (V1-V4) are controlled by a timing circuit that is connected to a power supply.

In view of the above disclosure, the primary object of the SWCA is to not waste shower water by storing the cooled water, which flows during the initial flow of shower to water, for use at a later time. At this later time, hot water is available and the stored water can be timely reintroduced into the shower water flow mix.

The SWCA solves the waste of shower water in a simple to use manner: instead of turning on the manual hot water valve and allowing the initial cool water from the hot water source to flow into the drain, the SWCA utilizes a combination of valves that are added to the shower plumbing. The additional valves allow the cool water to be initially applied and stored in a water reservoir assembly from where the stored water is timely released into the shower water mix.

In addition to the primary object of the invention it is also an object of the invention to provide an SWCA that:

- The water saved is equivalent to the volume of water within the piping from the hot water source to the shower head, which in some cases may be substantial. For example, if two people shower at different times and the water heater is located far enough away to permit as much as 5 to 10 gallons of water to be stored and saved in the SWCA for each usage, the yearly savings in water could be as much as 3,650 to 7,300 gallons,
- utilizes a simple type of fabrication, as all of the elements that are used to assemble the SWCA are well known in the art and are easily procured,
- utilizes plumbing that is easily installed in existing showers and simple modifications can be made to the piping where single hot and cold valves are already employed,
- is easily installed in new buildings, as the piping is simple and straightforward and the water storage assembly of the SWCA can be located directly above the shower with only simple piping required,
- is dependable as little or no maintenance is required, and
- is cost effective from both a manufacture's and consumer's points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
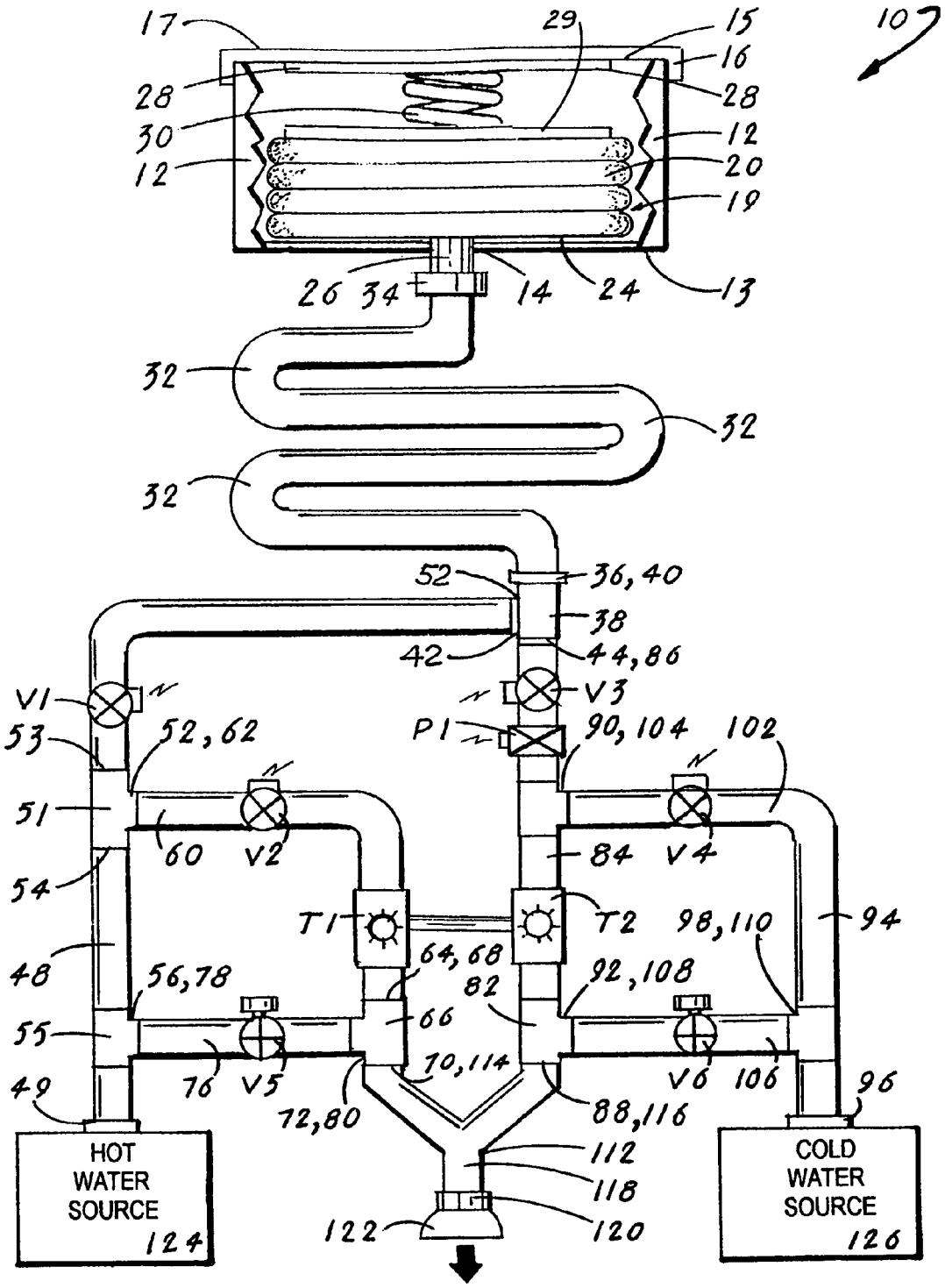
FIG. 1 is a schematic diagram of the elements that comprise the shower water conservation apparatus (SWCA).

The best mode for carrying out the invention is presented in terms of a preferred embodiment for a shower water conservation apparatus 10 (hereinafter "SWCA 10"). The SWCA 10 is designed to store the initial flow of cool water that is available when a shower is first turned on. The cool water is diverted to a water reservoir assembly where the cool water is stored until it is reintroduced at a later time into a regulated water flow mix.

The preferred embodiment of the SWCA 10, as shown in FIGS. 1-4, is comprised of the following major elements: a water reservoir enclosure 12, a water reservoir assembly 19, a coiled pipe 32, a set of four solenoid valves V1-V4, a water pump P1, a pair of turbines T1 and T2, a timing circuit 130 and a power supply 140. The inventive elements function in combination with a hot-water source 124, a cold water source 126, a manual hot-water valve V5, a manual cold-water valve V6 and a shower head 122.

Figure 2:
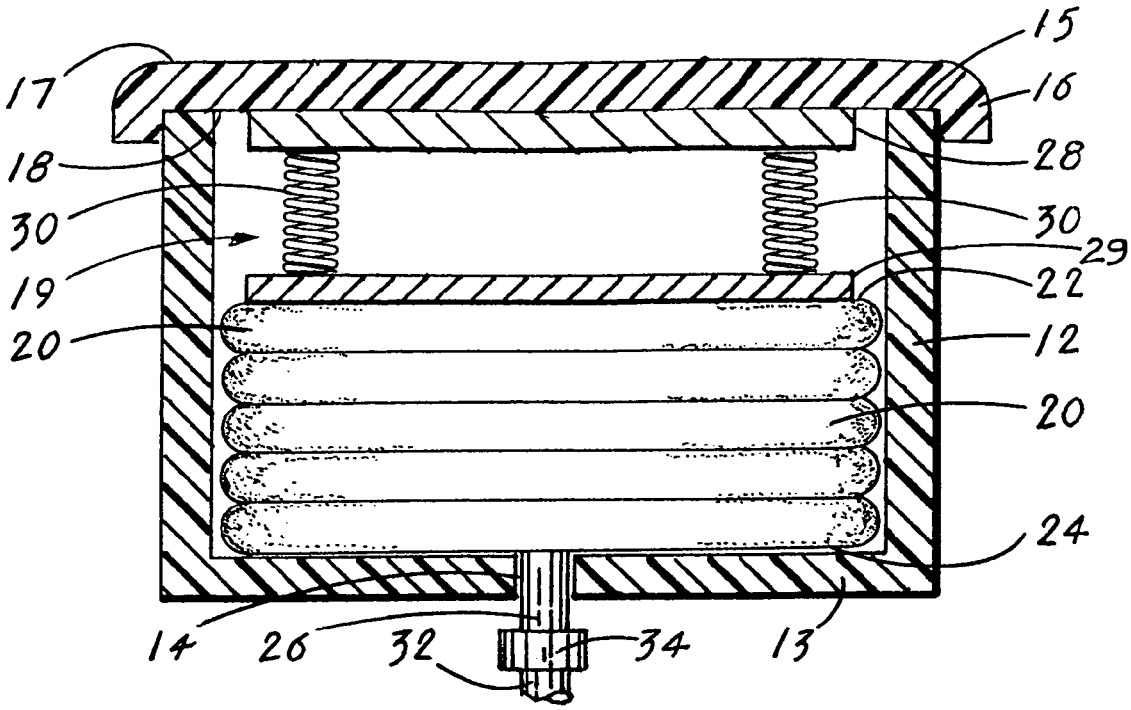
FIG. 2 is a cross-sectional, elevational view of the water reservoir enclosure and the water reservoir assembly shown removed from the SWCA.

The water reservoir enclosure 12, which is shown attached to the SWCA 10 in FIG. 1, and removed for the SWCA 10 in FIG. 2, is dimensioned to fit into a space that has been allocated for attaching the SWCA 10. The enclosure 12, which is preferably made of a thermoplastic, includes an integral lower section 13 that has, as best shown in FIG. 2, a water inlet/outlet bore 14 and an upper surface 15. To the upper surface 15 is attached a cover 16 having an upper surface 17 and a lower surface 18.

The water reservoir enclosure 12 is dimensioned to house the water reservoir assembly 19 that is comprised of a bellows 20, an upper spring attachment plate 28, a lower spring attachment plate 29 and at least one spring 30.

The bellows 20 is preferably made from a material that is selected from the group consisting of silicone-fiberglass, neoprene coated nylon, neoprene-latex, polyurethane or any other like material. The bellows 20 has a shape that best accommodates the shape of the water reservoir enclosure 12 which includes a circular, square or rectangular shape. As best shown in FIG. 2, the bellows 20 has an upper surface 22 and a lower surface 24. The lower surface has attached thereto a water inlet/outlet port 26 that extends outward from the water inlet/outlet port bore 14 located on the lower section 13 of the water reservoir enclosure 12.

The upper spring attachment plate 28, as also shown in FIG. 2, interfaces with the lower surface 18 of the cover 16. The lower spring attachment plate 29 interfaces with the upper surface 22 of the bellows 20. Both of the plates are dimensioned to substantially follow the perimeter of the bellows 20.

As best shown in FIG. 2, the at least one spring 30 is attached between the plate 28 and the plate 29. When water is not flowing into the bellows 20 the compressive force of the at least one spring 30 maintains the bellows 20 in a compressed configuration. Conversely, when water flows into the bellows 20 the pressure of the water overcomes the compressive force of the at least one spring 30, allowing the bellows 20 to expand and fill with water. The at least one spring 30 can consist of a central spring 30 or a pair of springs 30 can be utilized, as shown in FIGS. 1 and 2.

The coiled pipe 32 as best shown in FIG. 1 is located between the water reservoir assembly 19 and a plurality of pipes and valves that are described infra. The coiled pipe 32 has an upper port 34 that is attached to the water inlet/outlet port 26 that extends from the bellows 20. The coiled pipe 32 also has a lower port 36 that is attached to an upper port 40 as also described infra.

The coiled pipe 32 may be formed into a continuous coil in multiple vertical and horizontal layers or any convenient pattern that utilizes space economically. The material for the coiled pipe 32 can consist of a metallic or thermoplastic resin pipe or hose in either a rigid, semi-rigid or completely flexible configuration. A polyvinyl chloride pipe with fittings for entrance and exit of water flow may be used as the rigid configuration, however the preferred pipe material is a flexible thermoplastic clear polystyrene resin having a nominal diameter of 0.375 inches to 0.5 inches (0.95 cm to 1.27 cm).

The purpose of the coiled pipe 32 is to store the cooled water for alter usage, with the configuration and length governed by the distance the water has to travel from the hot water source 124 to the shower head 122. For practical usage only a few sizes would be manufactured to satisfy the need in must most cases.

The plumbing circuit that operates the SWCA 10, is shown in FIG. 1 and includes:

A first vertical pipe 48 having a lower port 49 that is attached to the hot-water source 124, an outlet port 50 that is attached to the side port 42 on the T-section 38, a T-section 51 having a side port 52, an upper port 53 and a lower port 54, a T-section 55 having a side port 56, and a solenoid valve V1 that is connected in series between the upper port 53 and the outlet port 50.

A first horizontal pipe 60 having an inlet port 62 that is attached to the side port 52 that is located on the first vertical pipe 48, an outlet port 64 that is attached to an upper port 68 of a T-section 66 further having a lower outlet port 70 and a side port 72, and a solenoid valve V2 and a turbine T1 that are each connected in series between the inlet port 62 and the outlet port 64.

A second horizontal pipe 76 having an inlet port 78 that is attached to the second side port 56 that is located on the first vertical pipe 48, an outlet port 80 that is attached to the side port 72 that is located on the T-section 66, a manually controlled hot-water valve V5 that is connected in series between the inlet port 78 and the outlet port 80 located on the T-section 66.

A second vertical pipe 84 having an inlet/outlet port 86 that is attached to the lower port 44 of the T-section 38, a lower outlet port 88 that is located on a T-section 82, a first side port 90 that is located on T-section 91, a second side port 92 that is located on to the T-section 82, a solenoid valve V3 that is connected in series with a water pump P1, wherein both the valve V3 and the water pump P1 are connected in series between the inlet/outlet port 86 and the first side port 90, and a turbine T2 that is connected in series between the T-section 82 and the T-section 91.

A third vertical pipe 94 having a cold-water inlet port 96 that is attached to the cold water source 126, a third horizontal pipe 102 having an outlet port 104 that is attached to the first side port 90 located on the T-section 91, a solenoid valve V4 that is connected in series between the inlet port 96 and the outlet port 104.

A fourth horizontal pipe 106 having an outlet port 108 that is attached to the second side port 92 located on the T-section 82 and an inlet port 110 that is attached to a second inlet port 98 located on the third vertical pipe 94, and a manually controlled cold-water valve V6 that is connected in series between the inlet port 110, and the outlet port 108.

A wye-pipe fitting 112 having a hot-water inlet port 114 that is attached to the lower outlet port 70 located on the T-section 66, a cold-water inlet port 116 that is attached to the lower outlet port 88 located on the T-section 82, and a vertical pipe 118 having an upper end that integrally intersects the wye-pipe fitting 112, and a lower end having an outlet port 120 that is attached to the shower head 122.

Figure 3:
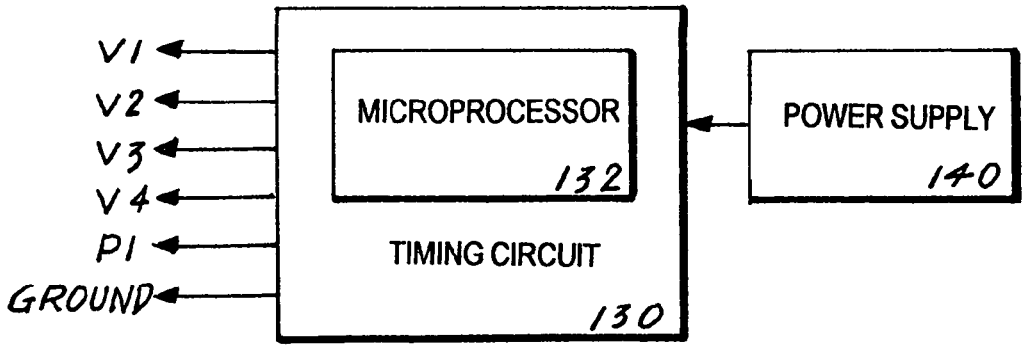
FIG. 3 is a block diagram showing a typical timing circuit that controls the on and off cycles of a set of solenoid valves and a water pump that control the operation of the SWCA.

The timing circuit 130, as shown in FIG. 3, includes a microprocessor 132 that is programmed to produce a series of sequential power outputs that are applied to each of the valves V1-V4 and to the water pump P1. The power outputs are programmed to operate the valves V1-V4 and the water pump P1 in a pre-selected operational sequence. There are various programmed-timing circuits available in the electronics industry. Therefore, a detailed description of the timing circuit 130 is not presented.

Figure 4:
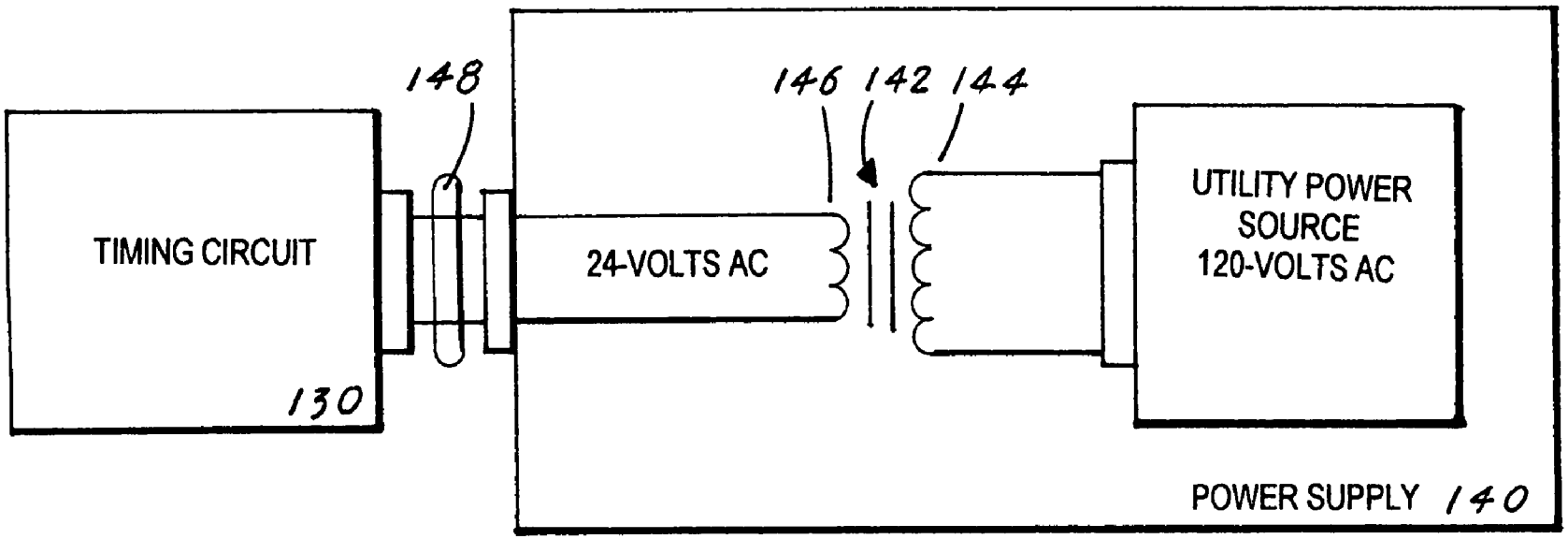
FIG. 4 is a schematic diagram of a typical electrical power supply that powers the timing circuit.

The power supply 140, as shown in FIG. 4, is comprised of a step-down transformer 142 having a primary winding 144 and a secondary winding 146. The primary winding 144 is connected to a utility power source consisting of 120-volts a-c. 60 Hertz. The secondary winding 146 steps the voltage down to 24-volts a-c, 60 Hertz which is applied to the timing circuit 130 for further processing and application to the valves V1-V4 and the water pump P1. The output from the power supply 140 can be applied to the timing circuit 130 by means of a cable 148, as shown in FIG. 4, or the output can be hardwired.

It should be noted that the SWCA 10 may be incorporated with plumbing of any conventional type, such as galvanized steel, copper or polyvinyl chloride (PVC) pipe, all of which are in common usage in this country. While it is easier to install the SWCA 10 in new construction buildings it may also be retrofitted in existing structures. It is also anticipated that the coiled pipe 32 may be eliminated and the water reservoir assembly 19 increased in size, while still providing the same functional capabilities at a reduced cost.

While the invention has been described in detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A shower water conversation apparatus (SWCA) that functions in combination with a hot water source (124), a cold-water source (126), a manual hot-water valve (V5), a manual cold-water valve (V6) and a shower head (122), said SWCA comprising:

a) a water reservoir enclosure (12) that includes an integral lower section (13) having a water inlet/outlet port bore (14), and an upper surface (15) to which is attached a cover (16) having an upper surface (17) and a lower surface (18), wherein said water reservoir enclosure is fabricated of a thermoplastic material, b) a water reservoir assembly (19) comprising:

(1) a bellows (20) that is located within said water reservoir enclosure (12), and that has an upper surface (22) and a lower surface (24) having attached thereto a water inlet/outlet port (26) that extends outward from the water inlet/outlet port bore (14) located on the lower section (13) of said water reservoir enclosure (12), wherein said bellows is fabricated from a material selected from the group consisting of silicone-fiberglass, neoprene-coated nylon, neoprene-latex and polyurethane, wherein said bellows has a square or a rectangular shape, (2) an upper spring attachment plate (28) that interfaces with the lower surface (18) of the cover (16), (3) a lower spring attachment plate (29) that interfaces with the upper surface (22) of said bellows (20), (4) at least one spring (30) that is attached between the upper spring attachment plate (28) and the lower spring attachment plate (29), wherein when water is not flowing into said bellows (20) the compressive force of the at least one spring (30) maintains said bellows (20) in a compressed configuration conversely, when water flows into said bellows (20) the pressure of the water overcomes the compressive force of the at least one spring (30) allowing said bellows (20) to expand and fill with water, c) a coiled pipe (32) having an upper port (34) that is attached to the water inlet/outlet port (16) that extends outward from the lower section (13) of said water reservoir enclosure (12), said coiled pipe (32) also having a lower port (36) that is attached an upper port (40) of a T-section (38) further having a side port (42), and a lower port (44), wherein said coiled pipe (32) is further comprised of a plurality of pipes, wherein the plurality is a function of the space available to install said SWCA, wherein said coiled pipe is further comprised of a continuously coiled, clear flexible thermoplastic resin material having a nominal diameter ranging from 0.375-inches to 0.5-inches (0.95 cm to 1.27 cm), d) a first vertical pipe (48) having:

(1) a lower port (49) that is attached to the hot-water source (124), (2) an outlet port (50) that is attached to the side port (42) on the T-section (38), (3) a T-section (51) having a side port (52), an upper port (53) and a lower port (54), (4) a T-section (55) having a side port (56), and (5) a first solenoid valve (V1) that is connected in series between the upper port (53) and the outlet port (50), e) a first horizontal pipe (60) having:

(1) an inlet port (62) that is attached to the side port (52) that is located on the first vertical pipe (48), (2) an outlet port (64) that is attached to an upper port (68) of a T-section (66) further having a lower outlet port (70) and a side port (72), and (3) a second solenoid valve (V2) and a first turbine (T1) that are each connected in series between the inlet port (62) and the outlet port (64), f) a second horizontal pipe (76) having:

(1) an inlet port (78) that is attached to the second side port (56) that is located on the first vertical pipe (48), (2) an outlet port (80) that is attached to the side port (72) that is located on the T-section (66), (3) a manual hot-water valve (V5) that is connected in series between the inlet port (78) and the outlet port (80), g) a second vertical pipe (84) having:

(1) an inlet/outlet port (86) that is attached to the lower port (44) of the T-section (38), (2) a lower outlet port (88) that is located on a T-section (82), (3) a first side port (90) that is located on T-section (91), (4) a second side port (92) that is located on the T-section (82), (5) a third solenoid valve (V3) that is connected in series with a water pump (P1), wherein both the third solenoid valve (V3) and the pump (P1) are connected in series between the inlet/outlet port (86) and the side port (90), and (6) a second turbine (T2) that is connected in series between the T-section (82) and the T-section (91), h) a third vertical pipe (94) having:

(1) a cold-water inlet port (96) that is attached to the cold water source (126), (2) a third horizontal pipe (102) having an outlet port (104) that is attached to the side port (90) located on the T-section (91), (3) a fourth solenoid valve (V4) that is connected in series between the cold water inlet port (96) and the outlet port (104), wherein said first solenoid valve, said second solenoid valve, said third solenoid valve and said fourth solenoid valve (V1-V4) are comprised of solenoid-operated gate or ball valves, (4) a fourth horizontal pipe (106) having an outlet port (108) that is attached to the second side port (92) located on the T-section (82) and an inlet port (110) that is attached to a side inlet port (98) located on the third vertical pipe (94), wherein said vertical and horizontal pipes are made of a material selected from the group consisting of polyvinyl chloride a thermoplastic resin and polystyrene, and (5) a manually controlled manual cold-water valve (V6) that is connected in series between the inlet port (110), and the outlet port (108), i) a wye-pipe fitting (112) having:

(1) a hot-water inlet port (114) that is attached to the lower outlet port (70) located on the T-section (66), (2) a cold-water inlet port (116) that is attached to the lower outlet port (88) located on the T-section (82), and (3) a vertical pipe (118) having an upper end that integrally intersects the wye-pipe fitting (112), and a lower end having an outlet port (120) that attaches to the shower head (122), j) a timing circuit (130) having means for sequentially controlling the open and closed cycles of said first solenoid valve, said second solenoid valve, said third solenoid valve, and said fourth solenoid valve (V1-V4) and the on and off periods of said first water pump (P1), k) a power supply (140) having means for supplying a voltage/current to operate said first solenoid valve, said second solenoid valve, said third solenoid valve, and said fourth solenoid valve (V1-V4) and said water pump (P1) and said timing circuit (130), wherein when said third solenoid valve (V3) is open, the water stored in the bellows (20) is allowed to flow out of the water inlet/outlet port (26) into the coiled pipe (32), said first water pump (P1), said second turbine (T2) and out of the shower head (122), wherein the water pressure is provided by a combination of forces provided by said at least one spring (30) and gravity, wherein said power supply further comprises:

a) an input circuit comprising a utility power source that provides 120 volts a-c, at a frequency from 50-60 Hertz, b) a step-down power transformer having a primary winding that is connected to the input circuit and a secondary winding that supplies 24 volts a-c, at a frequency from 50 to 60 Hertz that is connected to said timing circuit, said first solenoid valve, said second solenoid valve, said third solenoid valve, and said fourth solenoid valve (V1-V4) and to said water pump (P1), and a temperature gauge that is located in series with the vertical pipe that extends from the bottom of the wye fitting.

* * * * *